US007686745B2

(12) United States Patent
Koch

(10) Patent No.: US 7,686,745 B2
(45) Date of Patent: Mar. 30, 2010

(54) METHOD FOR TORSO MUSCLE LENGTHENING

(76) Inventor: Cynthia N. Koch, 10110 Hidden Meadows, Austin, TX (US) 78750

( * ) Notice: Subject to any disclaimer, the term of this patent is extended or adjusted under 35 U.S.C. 154(b) by 0 days.

(21) Appl. No.: 12/125,860

(22) Filed: May 22, 2008

(65) Prior Publication Data

US 2008/0287274 A1 Nov. 20, 2008

Related U.S. Application Data

(63) Continuation-in-part of application No. 11/108,506, filed on Apr. 18, 2005, now abandoned.

(51) Int. Cl.
*A63B 21/002* (2006.01)
*A61H 1/02* (2006.01)

(52) U.S. Cl. ..... 482/91; 482/131; 482/148; 482/907

(58) Field of Classification Search ..... 482/91, 482/92, 109, 126, 131, 148, 907
See application file for complete search history.

(56) References Cited

U.S. PATENT DOCUMENTS

| | | | | |
|---|---|---|---|---|
| 1,922,169 | A * | 8/1933 | Martin | 15/222 |
| 4,921,245 | A * | 5/1990 | Roberts | 482/42 |
| 5,169,362 | A * | 12/1992 | Schwartz | 482/96 |
| 5,176,602 | A * | 1/1993 | Roberts | 482/131 |
| 6,659,946 | B1 * | 12/2003 | Batchelor et al. | 600/300 |
| 7,008,359 | B2 * | 3/2006 | Fan et al. | 482/146 |
| 7,223,212 | B2 * | 5/2007 | DiOrio et al. | 482/83 |
| 2004/0132590 | A1 * | 7/2004 | Papas | 482/109 |
| 2005/0107223 | A1 * | 5/2005 | Finn | 482/91 |
| 2005/0239604 | A1 * | 10/2005 | Denham | 482/23 |

OTHER PUBLICATIONS

Ittman, Edward, Physical Culture by Means of Muscular Resistance and Breathing Exercises, Richard K. Fox Publishing Co., NY, NY, pp. 20-21, 1904. Downloaded from www.sandowplus.co.uk.*

Will's Cigarettes, Physical Culture Series, Issued in UK in 1914, images downloaded from www.sandowplus.co.uk.*

Muller, J.P., My System 15 Minutes Exercise a Day for Health's Sake, Athletic Publications, Ltd., London, pp. 83-86, 1938. Downloaded from www.sandowplus.co.uk.*

Ferguson, Cathy, Training Tips Don't Stretch Your Luck—Shun These Motions, Orange County Register, Santa Ana CA, Mar. 29, 1994, Morning Edition, p. v21.*

* cited by examiner

*Primary Examiner*—Nicholas D Lucchesi
*Assistant Examiner*—Victor K Hwang

(57) ABSTRACT

Posture improvement by conducting a set of stretch protocols with an inelastic strap which lengthen front torso muscles in order to reduce forward head position, and to decrease rounded shoulders. Posture improvement is monitored by periodically taking hip to rib, sternum to shoulder, and shoulder to shoulder measurements. The protocols may be performed at home, or in groups such as company sponsored activity. The strap may include markings to permit a participant to readily determine desired hand positions on the strap for a stretch protocol.

9 Claims, 10 Drawing Sheets

METHOD FOR TORSO MUSCLE LENGTHENING

RELATED APPLICATIONS

This is a continuation-in-part application of U.S. application Ser. No. 11/108,506 filed by applicant on Apr. 18, 2005, now abandoned.

FIELD OF INVENTION

This invention relates to a method and apparatus for lengthening human torso muscles by a series of manual stretching exercises conducted with a strap, and monitoring the improvement from those exercises with specific posture-related measurements.

BACKGROUND OF THE INVENTION

Today's lifestyle of television, computers, and automobile driving has led to a decline in most people's posture. In general, that impaired posture is a combination of a forward head position, rounded shoulders, and raised shoulders. The forward head position causes, or is caused by, a shortening of some torso muscles and a corresponding lengthening of muscles in the back. Similarly, the rounded shoulders cause, or, are caused by shortening of upper chest muscles—the pee minor and the pectoralis; and involuntary lengthening of the upper back muscles, the trapezius, deltoid and rhomboid, and the neck muscles—lavatory, scapula and stenoid, thus creating both rounded shoulders and forward the head position.

In order to improve posture, it is desirable to lengthen specific torso muscles to permit a relaxation and shortening of the muscles in the back.

In one embodiment of the current invention, a set of six specific stretch exercises is performed three times per day in short sessions of 3-5 minutes. A seventh exercise is a final breathing sequence. Several posture-related measurements are provided, including a rib to hip measurement, a shoulder to shoulder measurement, and a sternum to shoulder measurement. Sustainable improvements in posture will be indicated by increased lengths of front muscles and decreased lengths of back muscles to create balance of the front and back muscles in these measurements.

Most forms of exercise aggravate a poor posture condition, and it is desirable to lengthen the torso muscles and to achieve a better balance before beginning exercise routines. It is desirable to approach the problem in the sequence of "lengthen—balance—strengthen", which is a motto of the current invention.

The practice of stretching before exercise is common to many sports or activities, such as marathon runners, aerobics teachers, or the casual jogger. It is generally desirable to lengthen muscles before engaging in strengthening activities.

This lengthening is also important in posture improvement, but most people do not recognize the need to lengthen first, or they do not know how to accomplish that lengthening. To aggravate that problem, many common exercises, such as situps, only compound the posture problem by shortening muscles which should be lengthened.

One reason that exercise regimes fail is that they do not incorporate adequate muscle lengthening either in conjunction with muscle strengthening, or between the muscle strengthening exercises. One consequence of inadequate muscle lengthening is discomfort during exercise.

It is desirable to rotate the body upwards in order to relieve back and shoulder pain and to improve posture. Specific muscles must be lengthened to support this rotation. It is desirable to provide a group of "pre-exercises" to accomplish this muscle lengthening.

The muscle lengthening contributes to improved posture, which in turn leads to reduced stress, improved breathing, and improved appearance, and improved attitude.

Humans are not meant to function while being compressed and misaligned. Improper posture attacks the digestive system, lungs, and liver, everything in the midsection of the body. The lungs are forced to take shallow breaths. The stomach tries to digest food while compressed. The entire digestive tract is like a garden hose tied in knots. Improved posture may also lead to reduced symptoms of TMJ, carpal tunnel syndrome, and prostate conditions. With TMJ if the front shoulder muscles are lengthened and the back muscles are shortened and therefore the forward head position is reduced, this will allow the jaw the freedom to move back into proper alignment. With Carpal Tunnel Syndrome the body is pulled forward and the back muscles are stretched to inappropriate lengths which can cause nerves to be pinched and the blood flow to be constricted causing a stagnation down the arm much like having a tourniquet on the upper are close to the shoulder. Many other lower abdominal problems can be caused by the same shortening of the front muscles and lengthening of the back muscles. This compression continues to inhibit these major organs from working up to their capacity. The current invention efficiently addresses those alignment and compression problems by providing a short series of stretches that are specifically targeted at aligning the spine from the cervical to the sacrum.

Recently, posture has become a popular topic. Magazines, newspapers, and talk shows are frequently suggest ideas on how to improve posture. Some techniques suggest that a person imagine holding a string coming out of the top of his or her head like a marionette. Other techniques suggest pelvic thrust positions that resemble a shaking "S".

Although there are many suggested techniques for improving posture, most people's muscles, particularly women's muscles, are not lengthened enough to perform those techniques comfortably or effectively.

Most bodies are not ready for today's exercise without preparation of sufficient muscle lengthening. The way that a muscle is lengthened is important. Exercising a muscle that is out of its proper place can sometimes do more harm than good.

Good posture is a key to health, comfort and appearance. Many of us walk around with the front of our bodies shorter than the back. Shorter stomach muscles create an imbalance that may be difficult to notice. Lengthening these muscles, and balancing both sides of the body, gives a person a good start toward balance. The person has more energy to balance the rest of the body with greater ease.

If the front of the body is shortened, and the back muscles are lengthened out of their proper place, then the body is asked to work much too hard. After a while, these muscles produce pain in our shoulders or lower back. At this is the point, it is important to remember to stretch, and pull the body into balance. With increased awareness of posture, this balance can become more automatic.

The most common result of stress is fatigue. Sadly, we stress even more because we don't have enough energy to meet our obligations. This happens over and over each day, creating a build-up of lactic acid on our muscles. In this way, stress results in actual physical changes and triggers malfunctions in the body.

The accepted wisdom for years was that if you could do a hundred sit-ups every night you would have a flat stomach.

However, for most people their body is forward most of the day. They do not know how to lengthen their stomach yet or have not been doing the lengthening stretches long enough. Nighttime comes and you may do a few stretches before you launch into your nightly attempt to do sit-ups to flatten your stomach. However, by building muscles that are still shortened, you further compress the ribcage. Thickening the stomach muscles creates more of a paunch than before. Your stomach muscle may become rock-hard, but without the benefits of lengthening them first, before you strengthen them with sit-ups, you will not flatten your stomach.

Posture affects body alignment, and body alignment affects everything. Your organs will have the room to function properly, pain will ease or disappear, and you will have more energy to do the things you have to and want to do. When good posture is the habit and slouching is uncomfortable, you will have achieved good body alignment.

Proper body alignment is essential for exercise to be effective, but we usually associate alignment only with our bones. The fascia and muscle—everytime you move your arm you move fascia along with muscle-alignment is equally important to the proper functioning of your body. Shortened muscles pull bones, bones pinch nerves, and pinched nerves equal pain. Proper body alignment starts with lengthened, properly positioned muscles.

The by-product of modern life—stress, depression, too much to do in too little time-leave us bent over from the burden of it all. This shortens the muscles in the front of our bodies and lengthens the ones in the back, just the opposite of what the body needs to function well.

Straightening your posture and loosening the muscles takes undue pressure of the disks that have been pulled out of place by tight, shortened muscles.

Nerves fire electrical impulses to every part of the body. When nerves are pinched and confined, they cannot function effectively and the result is pain. The nerves in the middle of the spine also generate pain, although the back may not be where you feel it. The control panel may be sending a signal of pain to your liver, for instance, even though the problem has its origin in your back. Lengthening the surrounding muscles relieves this pressure on the spine, which reduces the sensation of pain.

It is desirable to provide a simple sequence of stretches to address the posture misalignment.

It is desirable to provide a sequence of stretches that is consistent with a variety of more advanced exercises or massage treatments.

It is desirable to provide a short sequence of stretches that can be done easily at home or at work without special exercise equipment.

It is desirable to provide a sequence of stretches that can be easily remembered and executed in a particular sequence.

It is desirable to provide a simple and lightweight device to facilitate performing the stretches.

It is desirable to provide a set of measurements that will indicate improvement in posture, in order to encourage continued stretching and a progression toward more advanced exercise routines of choice.

SUMMARY OF INVENTION

The current invention addresses common types of posture misalignment. A very common problem is the "forward head position" as indicated in the simplified schematic of FIG. 1A. In this position, the head 400 is held in a forward position, and front torso muscles 410 are shortened, while back muscles 420 are lengthened. This difference between the shortened front torso muscles 410 and the lengthened back muscles 420 causes, or, alternately, is caused by the forward head position. Once this condition occurs, it is not effective to simply attempt to hold the head back in its preferred orientation. This attempt will lead to discomfort in a short time. The more effective way to address the condition is to address the underlying problem of shortened torso muscles.

In the current invention, these front torso muscles 410 are lengthened, thereby permitting the back muscles 420 to relax or shorten, and permitting the head 400 to be held in a more vertical position as indicated in FIG. 1B. One measurement of the effectiveness of this lengthening of the torso muscles is the increase of distance between the hip and the rib. Another measurement of the effectiveness of this lengthening of the torso muscles is the increase of distance between the sternum and the shoulder.

A second problem is the "rounded shoulders" as indicated in FIG. 2A where the shoulders 430*a* and 430*b* are drawn closer together that desired. In this position, other front torso muscles 412 are shortened while back shoulder muscles 422, the levator scapulae, are lengthened. FIG. 2A is a simplified schematic illustrating a rounded shoulders position caused by shortened front torso muscles 412. In the current invention, these torso muscles are lengthened, thereby permitting the back shoulder muscles 422 to relax or shorten. FIG. 2B is a simplified schematic illustrating an improvement to the rounded shoulders position of FIG. 2A resulting from a lengthening of the front torso muscles and a relaxation and shortening of the levator scapulae muscle in the back. One measurement of the effectiveness of this lengthening of the torso muscles is the increase of distance between the shoulders.

A third problem, which is related to the rounded shoulders, is "raised shoulders" as indicated in FIG. 3A. In this position, the top of the shoulder muscles are shortened and elevated. In the current invention, these top of the shoulder muscles are lengthened, which permits a lowering of the shoulders and a release of constriction on the ribcage as illustrated in FIG. 3B.

One embodiment of the present invention is based on six movements which are stretches which may be done with a towel, a bathroom belt or a special strap. These six movements are preferably performed three times per day, for about 3 to 5 minutes per session. One embodiment of the invention is the combination of the strap and the stretching exercises.

The stretch movements leave the added benefit of waking up the lower stomach muscles and providing new vitality. As a person performs the stretches, the shortened muscles that connect the lower abdomen to the top of the leg begin lengthening, giving more freedom of motion in the pelvic area.

One objective of the stretches is to rotate a person's ribs upward. Lengthening stomach muscles, freeing internal organs, and deeper breathing are key to lasting relief. The extent of this upward rotation can be measured with a "hip-to-rib" measurement method. The combination of the stretch exercises and the "hip-to-rib" measurement method is another embodiment of the present invention.

Another measurement which is related to the posture improvement accomplished by the exercises, is a "pledge" measurement which is from the sternum to a shoulder. The combination of the stretch exercises and the "pledge" measurement method is another embodiment of the present invention.

Another measurement which is related to the posture improvement accomplished by the exercises, is a "shoulder-to-shoulder" measurement which is from one shoulder to the other shoulder. The combination of the stretch exercises and the "shoulder-to-shoulder measurement method is another embodiment of the present invention.

In another embodiment of the invention, a system of exercise and measurement is provided which comprises the stretching exercises, the stretch strap, the recording of exercise date and times, and the recording of "hip-to-rib", "pledge", and "shoulder-to-shoulder" measurements. The expected outcome of a diligent exercise program is that all of the measurements would show a sustained improvement. These measurements are quantifiable indices of improved posture. Other benefits of improved posture, such as improved breathing, improved appearance, and improved self esteem, are more difficult to quantify, but should accompany improvements in the measurements. The measurements serve both to feedback the results of the exercise, and to motivate a person to continue the exercise program and to seek continued improvement through advanced techniques such as yoga, Pilates, or massage.

In one embodiment, the stretching exercises are given names that suggest the desired position of the stretches in order to help a person remember and properly execute the series of stretches. Similarly, the measurements are provided with names which remind the participant how to take the desired measurement.

DESCRIPTION OF FIGURES

These and other features, aspects, and advantages of the present invention will become better understood with regard to the following description, appended claims, and accompanying drawings where:

DETAILED DESCRIPTION OF EMBODIMENT

Torso Muscle Lengthening with Stretch Sequence

In this embodiment, a person performs a series of six stretch exercises, preferably three times per day. Each exercise set takes approximately 3-5 minutes to perform until the person becomes comfortable with the set of movements, and then it becomes her choice as to how long to hold each movement.

An unexpected result of the current invention is that significant improvement in posture can be obtained by regular performance of a short series of stretching exercises.

Each exercise has a stance, and a hand grip position on a towel or stretch strap as described below. Each exercise uses a non-elastic strap, such as a medium weight towel, bathrobe belt, a necktie, or a strip of fabric. Elastic bands, such as physical therapist devices, should not be used for these stretches.

In this embodiment, the positions are named in a manner to suggest the desired position for executing the stretch. The stretches are designated as "Archer", "Liberty", "Victory", and "Balance". The Archer and Liberty positions have both a left and a right position.

Position One—"Archer" (Left)

In this example, the first position is called "archer" to describe one arm being outstretched as if to grasp a bow, and the other hand held generally as if to hold an arrow.

Figure 1A:
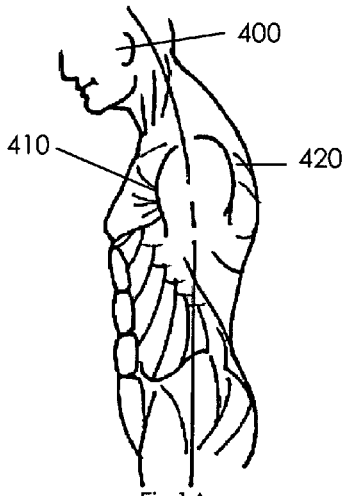
FIG. 1A is a simplified schematic of an exaggerated side view illustrating a forward head position caused by shortened front torso muscles and lengthened back muscles.
Figure 1B:
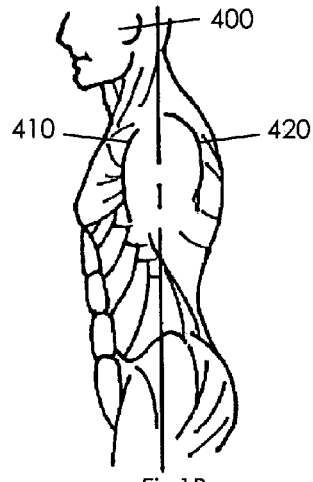
FIG. 1B is a simplified schematic illustrating an improvement to the forward head position of FIG. 1A resulting from a lengthening of the front torso muscles and a relaxation and shortening of the back muscles.
Figure 2A:
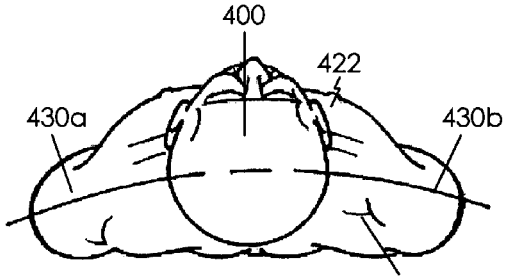
FIG. 2A is a simplified schematic of an exaggerated top view illustrating a rounded shoulders position caused by shortened front torso muscles.
Figure 2B:
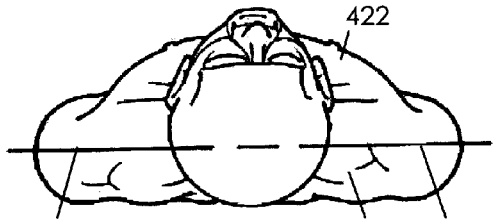
FIG. 2B is a simplified schematic illustrating an improvement to the rounded shoulders position of FIG. 2A resulting from a lengthening of the front torso muscles and a relaxation and shortening of the levator scapulae muscle in the back.
Figure 3A:
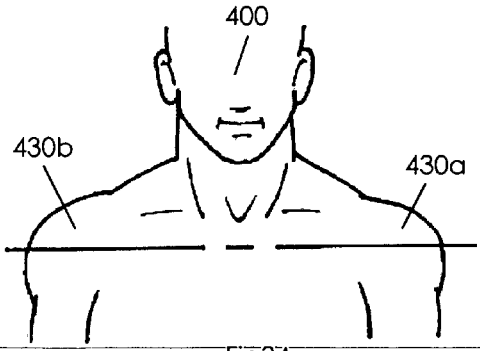
FIG. 3A is a simplified schematic of an exaggerated front view illustrating a raised shoulders position caused by shortening of upper chest muscles, the pee minor and the pectoralis; and involuntary lengthening of the upper back muscles, the trapezius, deltoid and rhomboid, on into the neck muscles, the lavatory, scapula and stenoid, thereby creating rounded shoulders and forward the head position.
Figure 3B:
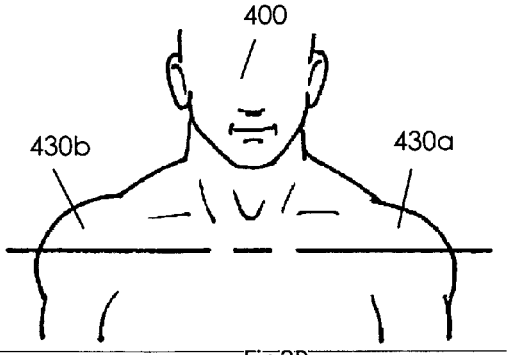
FIG. 3B is a simplified schematic illustrating an improvement to the raised shoulders position of FIG. 3A resulting from a lengthening of the upper trap muscles and a relaxation and shortening of the lower trap muscle.
Figure 4:
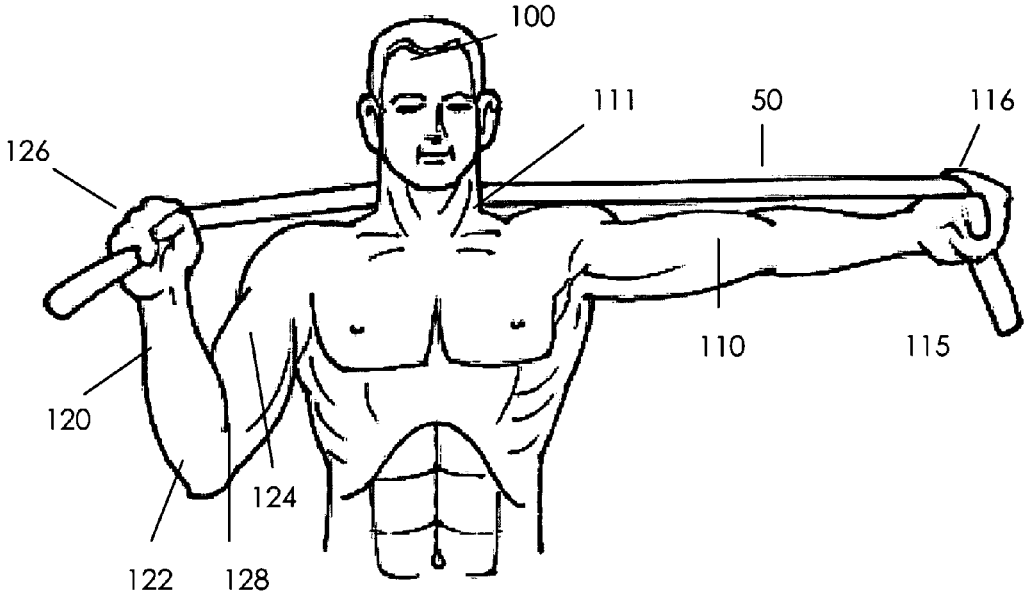
FIG. 4 is a schematic of a person in the first stretch position.

FIG. 4 is a schematic of a person in the first stretch position with a towel 50 or strap. The towel 50 is held along an opposite diagonal corner in each hand. The distance between the hands is selected so that the arms are in the position illustrated in FIG. 4. In the case of a strap 60 (not shown), the hands are placed at a distance apart so that the arms are in the position described below.

The towel or strap is placed behind the head 100. The left arm 110 is extended at the left shoulder 111 level, so that the left arm is parallel to the floor. The right arm 120 is bent at the right elbow 122, with the right upper arm 124 touching the right ribcage 128. The left knuckles 116 and the right knuckles 126 are facing outward from the body, and the left hand 115 is at the left shoulder is at the left shoulder 111 level. The left arm 110 and right arm 120 should be held in the same plane as the shoulders. A firm tension is applied to the towel or strap between the left hand and the right hand, thereby pulling the torso upward.

A normal breath is inhaled through the nose. The breath is exhaled through the mouth with pursed lips, pushing the air from the lungs as completely as possible. It is desirable to hold the tension on the strap while steadily exhaling. It is desirable to increase lung capacity with practice over time so that the duration of the exhale increases. The breathing helps to reduce stress and tensions.

The breathing should be repeated at least once more while the tension is maintained.

On the first day, each of the positions should be held to a count of four. The count should be increase at least one each day until reaching a count of about 8-10 seconds.

Position Two—"Archer" (Right)

The second position is also designated as "archer", and is symmetrical to the first position.

Figure 5:
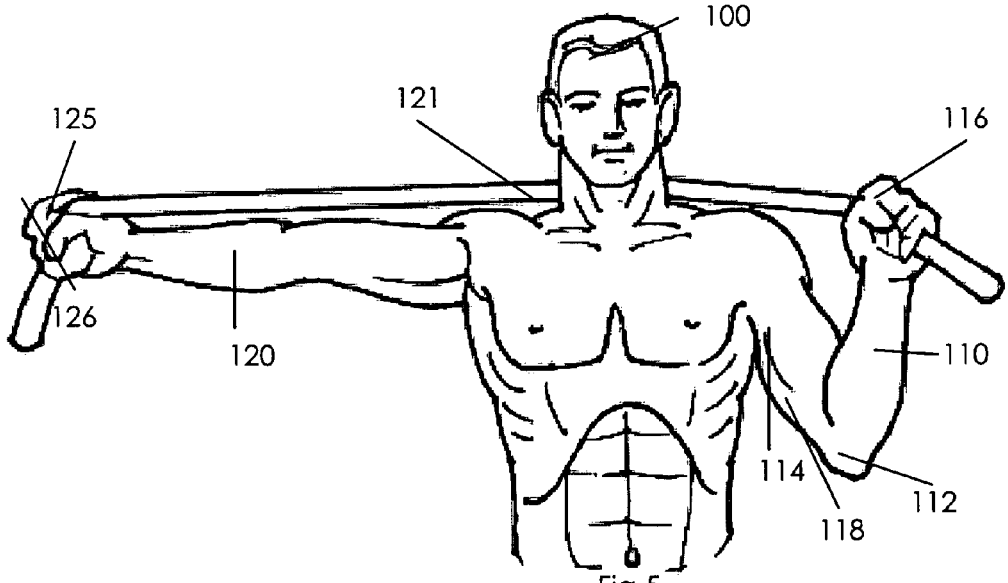
FIG. 5 is a schematic of a person in the second stretch position.

FIG. 5 is a schematic of a person in the second stretch position. After the first position, the strap should be smoothly moved to be placed in a mirror image of the first position so that the right arm 120 is extended. The towel or strap is kept or placed behind the head 100. The right arm 120 is extended at the right shoulder 121 level, so that the right arm is parallel to the floor. The left arm 110 is bent at the left elbow 112, with the left upper arm 114 touching the left ribcage 118. The left knuckles 116 and the right knuckles 126 are facing outward from the body, and the right hand 125 is at the right shoulder is at the right shoulder 121 level. The left arm 110 and right arm 120 should be held in the same plane as the shoulders. A firm tension is applied to the towel or strap between the left hand and the right hand. The towel or strap is used as a guide to move the hand straight out from the shoulder and parallel with the floor. The body should be square. Freeing the body so that it is in a square position is a goal of the stretches.

The breathing should be as in position one with a normal breath inhaled through the nose, and exhaled through the mouth. The breathing should be repeated at least once more while the tension is maintained.

Figure 14A:
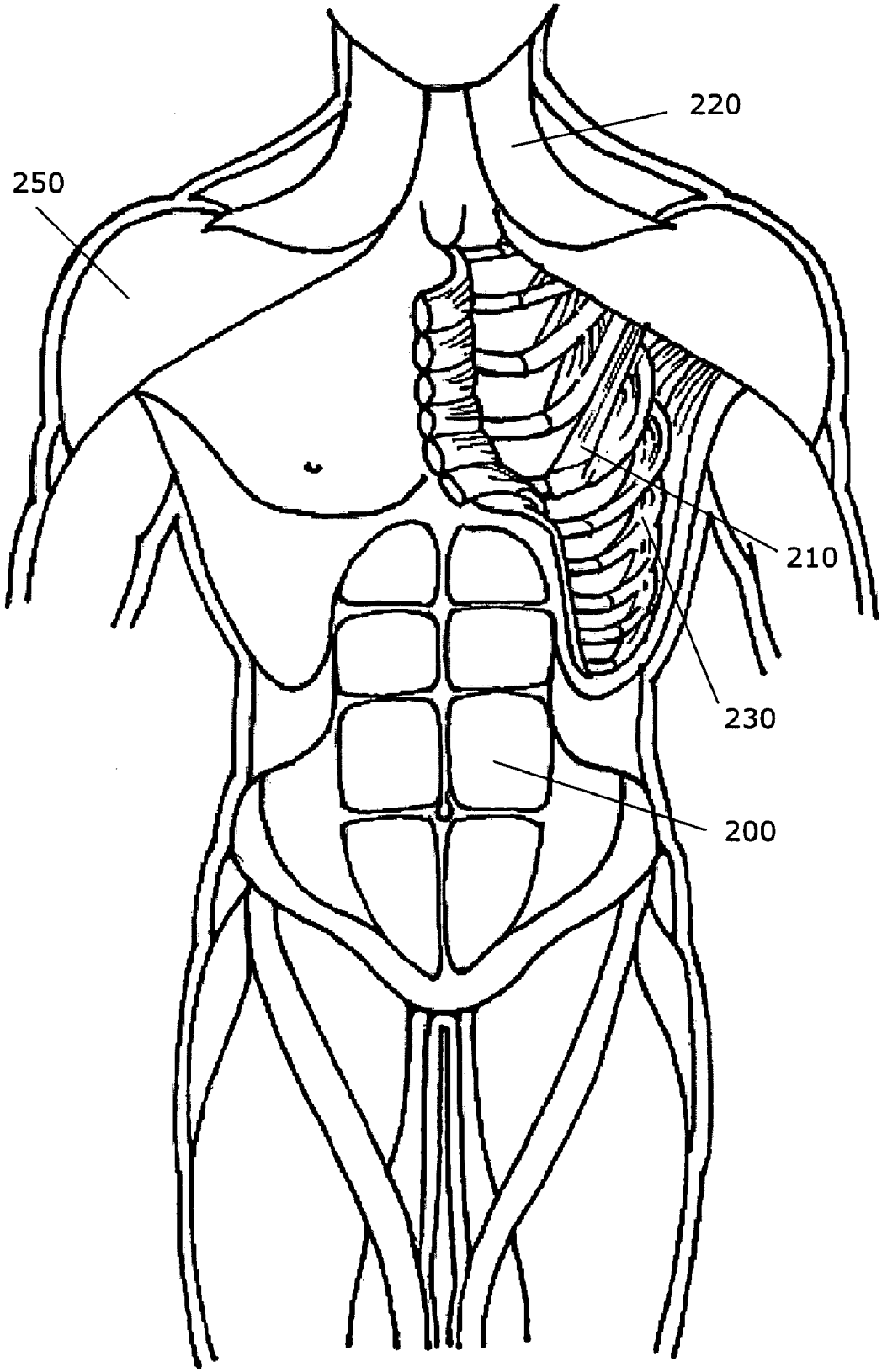
FIG. 14A is a front view of some torso muscles acted on by the stretch positions.
Figure 14B:
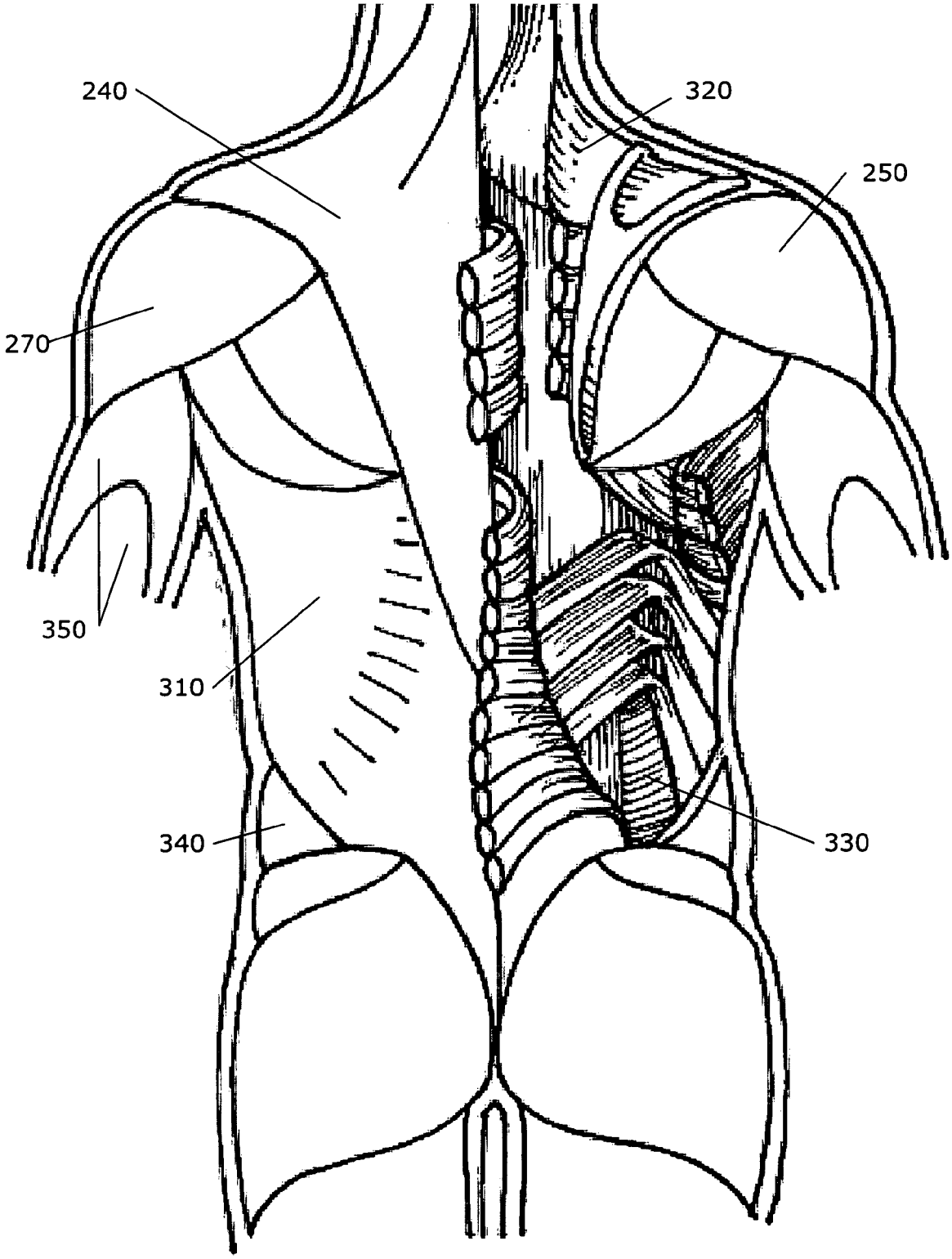
FIG. 14B is a rear view of some arm and back muscles acted on by the stretch positions.

FIGS. 14A-14B illustrate some of the torso and back muscles acted on by the "Archer" and other stretches.

The left and right Archer stretches address the lengthening of the rectus abdominis 200 by forcing the rib cage to rotate upward. Lifting the arm lengthens the pee minor 210. By lifting the ribcage, tension is released from the stenocleiedomastoid 220 allowing the head to pull back into comfortable position. In the back of the body this movement lifting the ribcage 230 releases tension on the trapezius 240, deltoid 250, teres major 260 and teres minor 270 muscles allowing the scapula freedom of movement and correct placement. The arm that is extended releases stress on biceps brachii and continuing muscles down to the wrist. The arm that is bent also opens the pee minor 210, thereby rotating the scapula 280 towards the spine.

Position 3—"Liberty" (Left)

The third and fourth positions are designated as "liberty" to suggest a Statue of Liberty position with one arm raised up as if holding a torch, and the other arm held by the side.

Figure 6A:
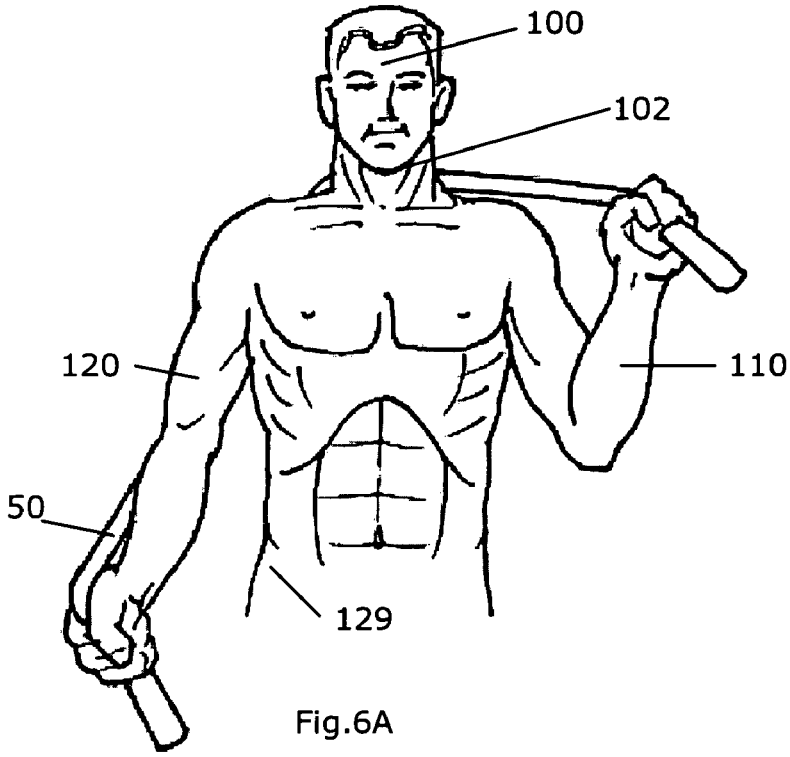
FIG. 6A is a schematic of a person in a first transition position toward the third stretch position.
Figure 6B:
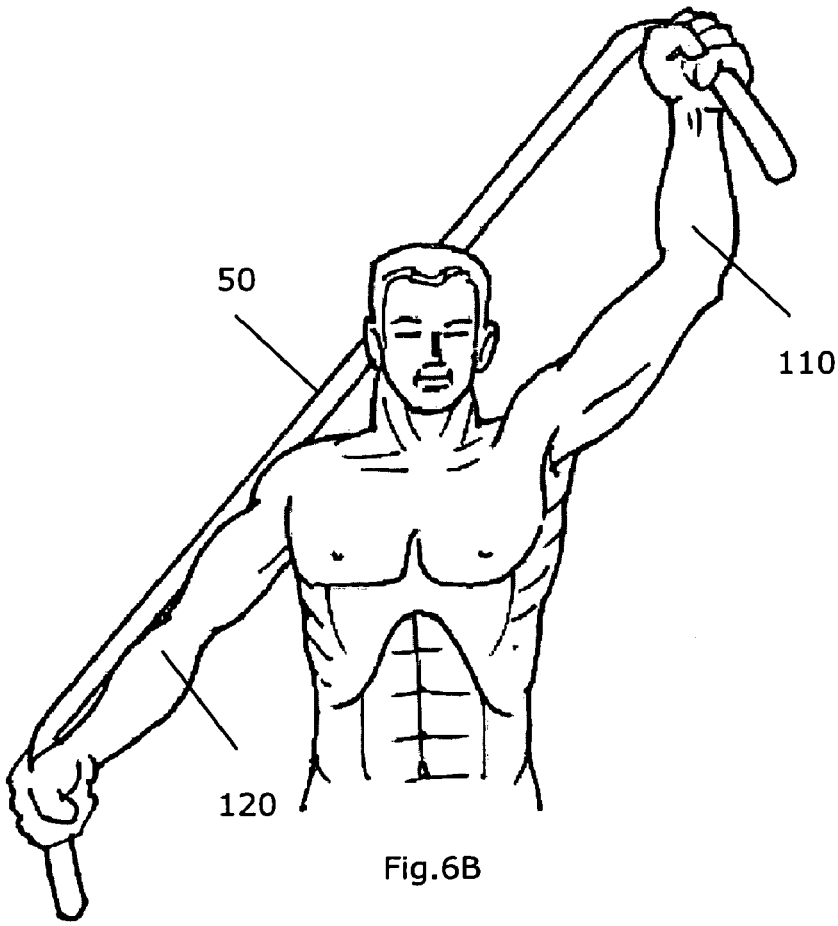
FIG. 6B is a schematic of a person in the third stretch position.

FIG. 6A is a schematic of a person in a first transition position toward the third stretch position. From Position 2, the extended right arm 120 is dropped to the right side 129 in a smooth motion. Another deep breath is inhaled and exhaled slowly while relaxing across the shoulders. The head 100 is turned from side to side, while the chin 102 is lifted. FIG. 6B is a schematic of a person in the third stretch position. In order to reach the third position, the left arm 110 is raised straight up, and the right arm 120 is moved slightly to the rear of the body. A normal breath is inhale through the nose, and exhaled as in the first two positions. The breathing is repeated at least once more while thoughts are kept positive and affirming.

Position 4—"Liberty" (Right)

Figure 7A:
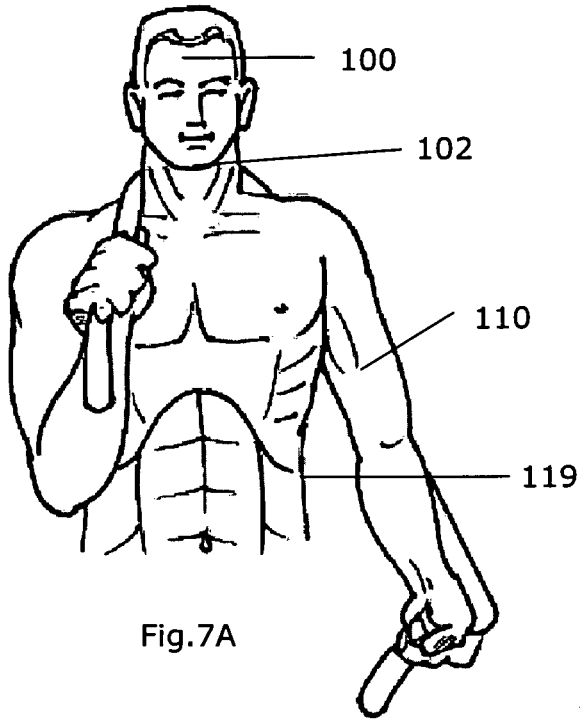
FIG. 7A is a schematic of a person in a first transition position toward the fourth stretch position.
Figure 7B:
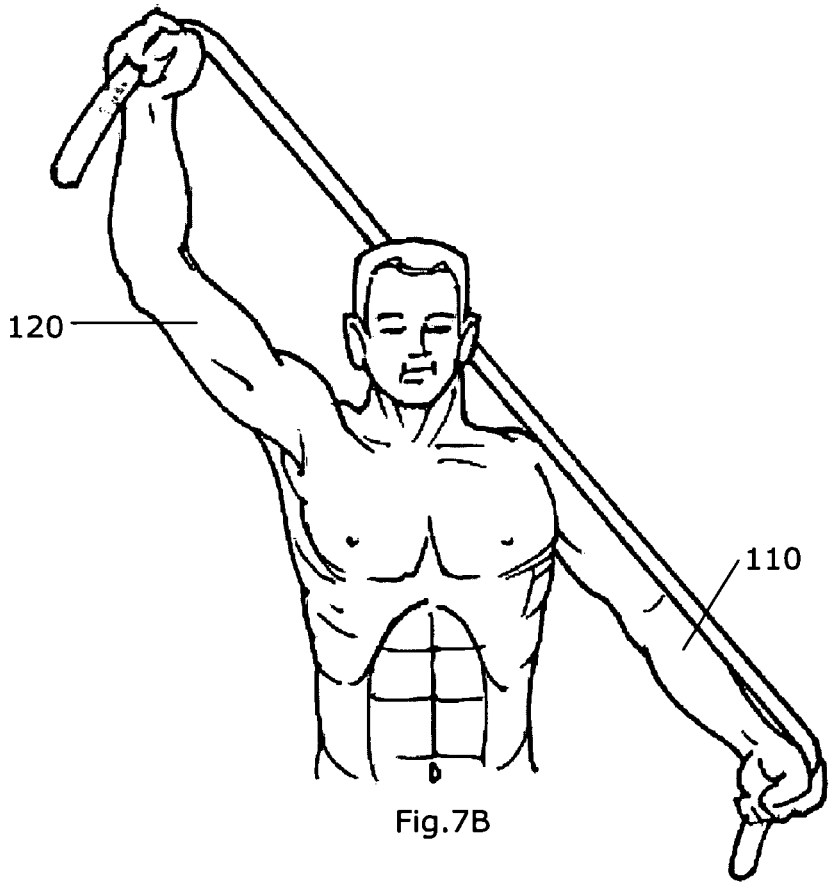
FIG. 7B is a schematic of a person in the fourth stretch position.

FIG. 7A is a schematic of a person in a first transition position toward the fourth stretch position. From Position 3, the extended left arm 110 is dropped to the left side 119 in a smooth motion. Another deep breath is inhaled and exhaled slowly while relaxing across the shoulders. The head 100 is turned from side to side, while the chin 102 is lifted. FIG. 7B is a schematic of a person in the fourth stretch position. In order to reach the fourth position, the right arm 120 is raised straight up, and the left arm 110 is moved slightly to the rear of the body.

A normal breath is inhale through the nose, and exhaled as in the first three positions. The breathing is repeated at least once more while thoughts are kept positive and affirming.

Referring again to FIGS. 14A and 14B, this left and right Liberty stretches address the release of the latissimus dorsi 310 by extending the arm upward. Lifting the arm furthers the lengthening of the pee minor 210 on the upwardly extended arm while laterally extending the pee minor 210 on the dropped arm. By enabling a release of the levator scapulae 320, this position enhances a more properly aligned chin placement during the movement.

This stretch further encourages the rotation of the rib cage to a more upright position specifically targeting the release of the insertion of the psoas muscle at the mid back. This is the bending point at the bottom of the rib cage which is stressed while in a sitting position. As lengthening occurs in the body with practice of this stretch the hip insertion of the psoas muscle also begins to relax releasing the hip and lower stomach.

Position 5—"Victory"

The fifth position is designated as "victory" to suggest the symmetrical position of the arms outstretched in a "V" above the head.

Figure 8A:
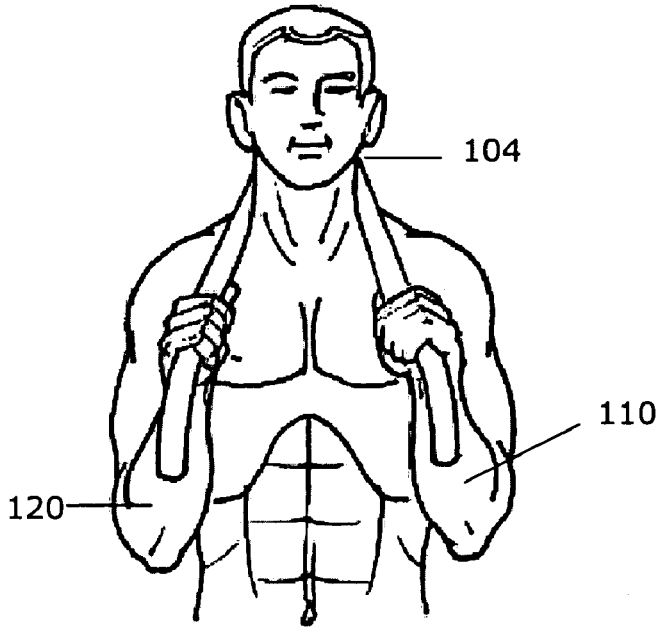
FIG. 8A is a schematic of a person in a first transition position toward the fifth stretch position.

FIG. 8A is a schematic of a person in a first transition position toward the fifth stretch position. From position 4, the raised right arm 120 is dropped, and the lowered left arm 110 is raised until both are in an elbow-flexed position as shown in FIG. 8A, with the towel resting around the neck 104.

Figure 8B:
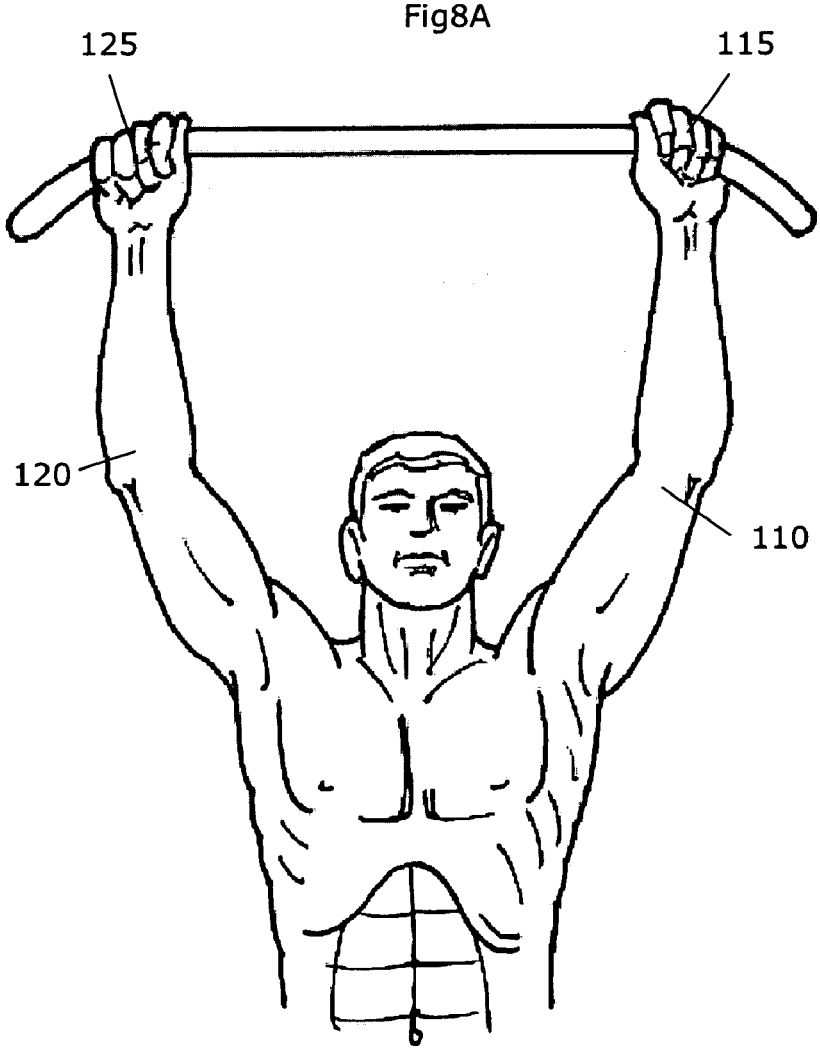
FIG. 8B is a schematic of a person in the fifth stretch position.

FIG. 8B is a schematic of a person in the fifth stretch position. The strap tension is released, and the left hand 115 and the right hand 125 are then lifted, and the strap is repositioned around the neck. The hand positions are shortened on the strap without the head moving forward so that the hands are straight above the head, and the position is held through at least two breath cycles as described above.

Referring again to FIGS. 14A and 14B, this movement addresses freedom in the core muscles by lengthening the internal oblique 330 and external oblique 340, thereby continuing the lengthening of the rectus abdominus 200 and the release of the ribcage 230. Other muscles involved include triceps brachii 350, laticissimus dorsii 310 and on down to the wrist.

As the arms are stretched above the head, the insertion of muscles to the spine is stretched as well as the stomach. The goal of this stretch is to balance your arms on the same alignment as your ears.

Position 6—"Balance"

The sixth position is designated as "balance" to suggest a scale where the arms are at the same level.

Figure 9A:
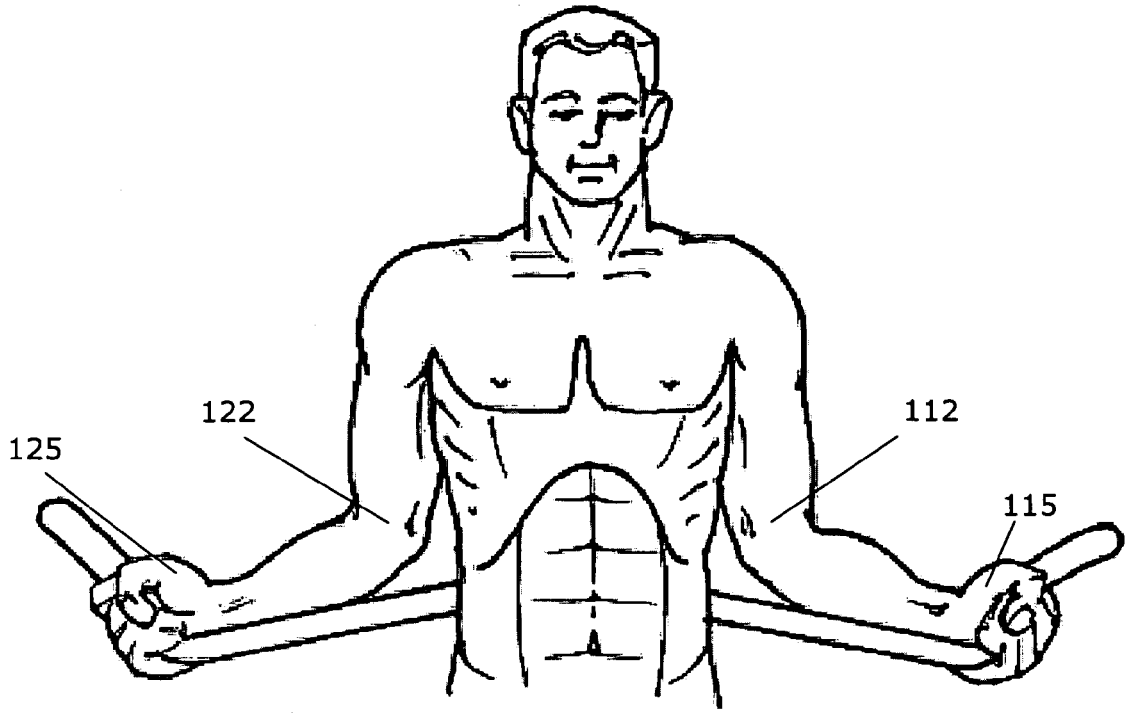
FIG. 9A is a schematic of a person in a first transition position toward the sixth stretch position.

FIG. 9A is a schematic of a person in a first transition position toward the sixth stretch position. From position 5, the raised arms are dropped. The arms are lowered until the strap is once again resting around the neck. The head is turned from side to side, and the strap is slid to a position around the waist, with the left elbow 112 and the right elbow 122 tucked against the ribs, with hands 115 and 125 extended in front of the body while holding the strap. The hands should be in a loose fist, parallel to each other as if on a steering wheel. The elbows should be kept tucked against the ribs.

Figure 9B:
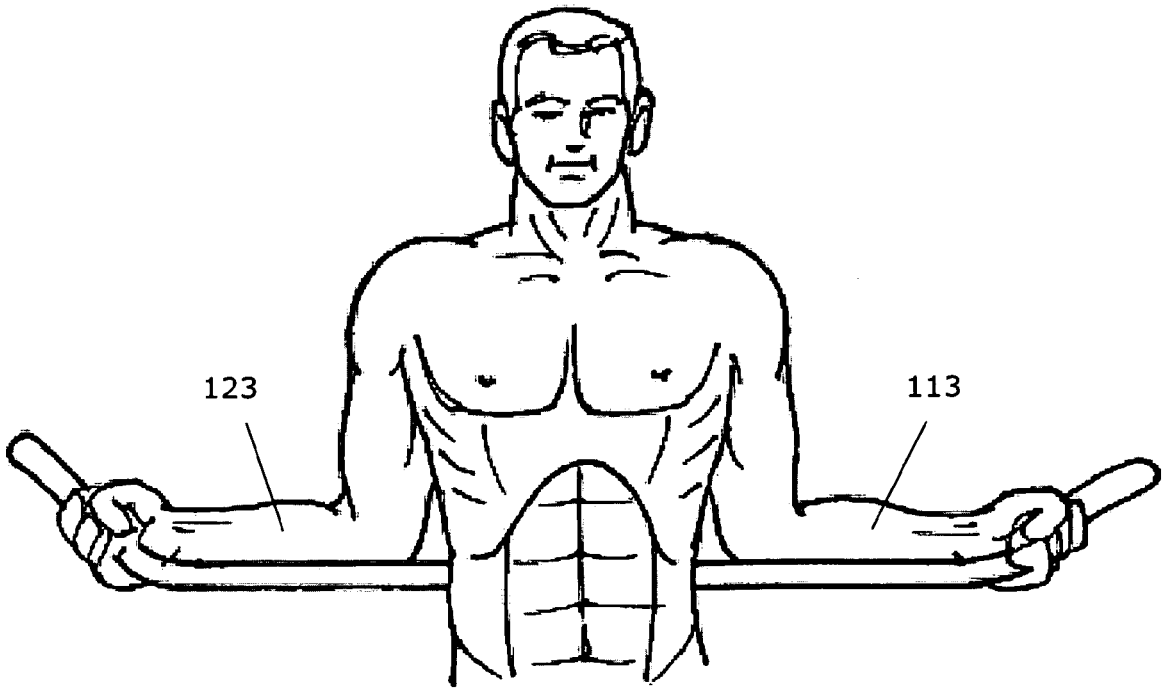
FIG. 9B is a schematic of a person in the sixth stretch position.

FIG. 9B is a schematic of a person in the sixth stretch position. The left forearm 113 and the right forearm 123 are opened as far as can be comfortably extended. The palms of the hands are upwards, while keeping the hands in a loose fist position. The head is turned from side to side twice.

This movement concludes the sequence by relaxing the body into proper alignment with lengthened front muscles, shortened back muscles and the resultant lowering of the shoulders and restored definition of the shoulder blades. Turning the head from side to side with prefect balance is now possible due to a lengthened levator scapulae 320, completing the restoration of proper posture with good head alignment.

This stretch further lengthens muscles attached to the sternum and rib cage. By keeping both arms close to the body the goal is to once again become comfortable, with help of the balance cord in an upright position noticing the additional space between the rib cage and hips.

These positions may be conducted in sequence on the first day of exercises, or may be introduced gradually over a few days' time. It is desirable to develop a routine of exercise so that the stretches are performed three times per day, such as morning, noon, and evening. The stretches may be performed in the workplace with minimal disruption, so they are well suited to performance at a work break. In one embodiment, corporate personnel departments sponsor the training for the exercise, and promote the routine exercise in order to improve employee health, moral, and productivity; and to lower employee lost time and health care costs.

Attention should be paid to the breathing technique that goes along with these stretches. Deeper breathing naturally occurs by the movements, however a deeper breathe with a slow forced exhale at least four counts encourages much needed oxygen to relax muscles. These breathes should be done with each position.

The length of time to hold each position will depend upon the individual. When first performing the exercises, it will be hard to hold these positions for very long. These stretches are designed as a re-lengthening, retraining of up3ward muscle structure. With practice, the stretches may be comfortably held for a longer duration as the muscles lengthen. After a few weeks of practice, the goal is that the body will not be comfortable unless it is in an upright position.

Our bodies work best while in the correct position. Many of today's health issues may be benefited or avoided by correcting pour structure.

Forward head position is a common problem because of the time we spend sitting at a computer or driving a car. Lifting the rib cage and pulling the spine back up straight may eliminate this problem and provide benefit to related health issues such as TMJ and hearing disabilities.

Carpal tunnel is often a consequence of working at a computer terminal, which causes our arms to go forward. This forward position of the arms puts large amounts of stress on back muscles which are directly affected by every muscle running down the arm. Improving the structure may reduce carpal tunnel.

Asthma problems may be reduced through these stretches, which will aide in retaining muscles to relax and open. The breathing technique accompanying the stretches will encourage lung expansion. With continued practice of these movements the body will be trained to relax faster in times of trauma.

Digestive problems may be reduced by releasing space in the mid-section of the body and allowing organs and systems to function properly.

The stretches reduce the constriction in the abdominal region may also release prostate problems in men and endometrioses in women.

The stretches increase oxygen in the body, reduce fatigue, and increase mental ability.

The presence of pain changes personalities. Removing neck tension and general pain across the shoulders removes grumpy personalities.

It is well known that habits are formed within six weeks. Therefore, six weeks worth of effort doing these stretches will create habits of comfort within the body. Increased knowledge and understanding of structure will enhance further success in continued exercise programs. Time is an issue in today's lifestyle. These movements retrain muscles without going to a special place or buying large equipment.

After doing these movements for six weeks the participant is expected to discover a new awareness of her body including visible and measurement changes in structure. The participant may have reduced neck and shoulder tension, increase in stomach control, overall increase in energy, and a positive boost in self image. Individual benefits will occur for each person. This cycle will aid in creating balance booth structurally and mentally to life.

Final Breathing Positions

In this embodiment, two final breathing positions are employed after Position 6. The arms are left in Position 6. The strap may be dropped or loosely held. The head is turned to the left and a deep breath is taken in and let out slowly. The head is then turned to the right and a deep breath is taken in and let out slowly.

Lengthening Stretches and Measurements

In this embodiment, lengthening exercises such as those described above are conducted, and measurements are taken such as those described below.

Rib-to-Hip Measurement

The follow sequence with exaggerated positions illustrates a rib-to-hip measurement. Place one hand on the hip, and slump down on the hand in an extreme slouch. Slowly lift the rib cage and feel the distance between the ribs and hip increase. Another way to observe an exaggerated change in this measurement is to take it first from a sitting position, where the space becomes small as we slouch over in our usual comfortable position. Then, stand up and measure the distance again, noticing the increase in the measurement. Now rotate your ribcage upward and notice the dramatic increase in the measurement. One object of performing this measurement is to document the sustainable improvement in the distance when stretches are regularly performed. Another object of the measurement is to provide encouragement for a person to continue the stretches over time—similar to the encouragement that weight loss would provide to a dieter.

This is a tangible measurement you can be taken any time during the day. The measurement is a physical reminder to push up the ribcage, thereby creating better posture. The improvement is not merely from pushing the shoulder back, it represents straightening the back and lifting the ribcage. The person should feel more relaxed in this new position. No one expects a body to do a backbend or the splits without a great deal of preparation.

Similarly, standing upright in a fully extended position also takes preparation, a repositioning of your bones and muscles into their natural, health and balanced places.

Figure 11:
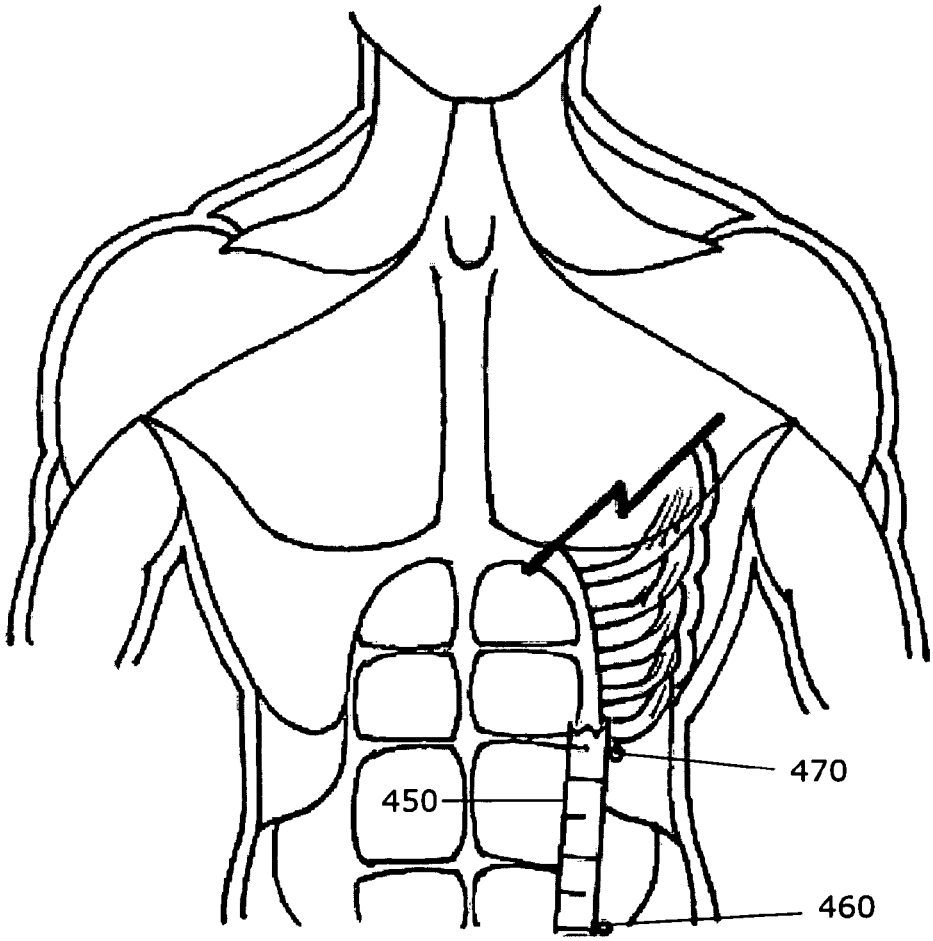
FIG. 11 is a front view of a person illustrating the "hip-to-rib" measurement.

FIG. 11 is a front view of a person illustrating the "hip-to-rib" measurement of a person, showing some of the left ribs 471. The rib-to-hip measurement may be taken by placing one end of a ruler 450 or tape on the hip 460 and rotating the ruler until it crosses the nearest point of the lowest rib 470. The ruler may be grasped at this point so that the position of the grasp indicates the distance between the rib and hip. Another method is to stretch a string between the rib and hip, and then measure the string.

In the embodiment above, the first two muscles to work on after a day of slouching are the abs (rectis abdominus) 200 and pec minors (pectoris minor) 210. The first muscle runs the length of the stomach from the bottom of the breastbone to the pelvis. The latter runs from the third, fourth, and fifth ribs up to the shoulder socket. By the end of the day, they have typically been shortened by poor posture, which has lengthened the back muscles to an uncomfortable degree. Lengthening these "front" muscles will relieve the back muscles all the way down the back, and will eventually result in upright posture.

These muscles don't exist in a vacuum, however. They are layered with other muscles that perform auxiliary functions that enable us to do everything from housework to dancing. We need them all, but we need them to work together well. The beauty of the positions is that when you work the abs, it takes the other muscles in the layer with it. When you lengthen the abs, freeing the ribcage, you lengthen all the muscles in the layer as well.

A quick check can be obtained by plotting one's daily or weekly progress in increasing the rib-to-hip distance.

Pledge Measurement

Figure 12:
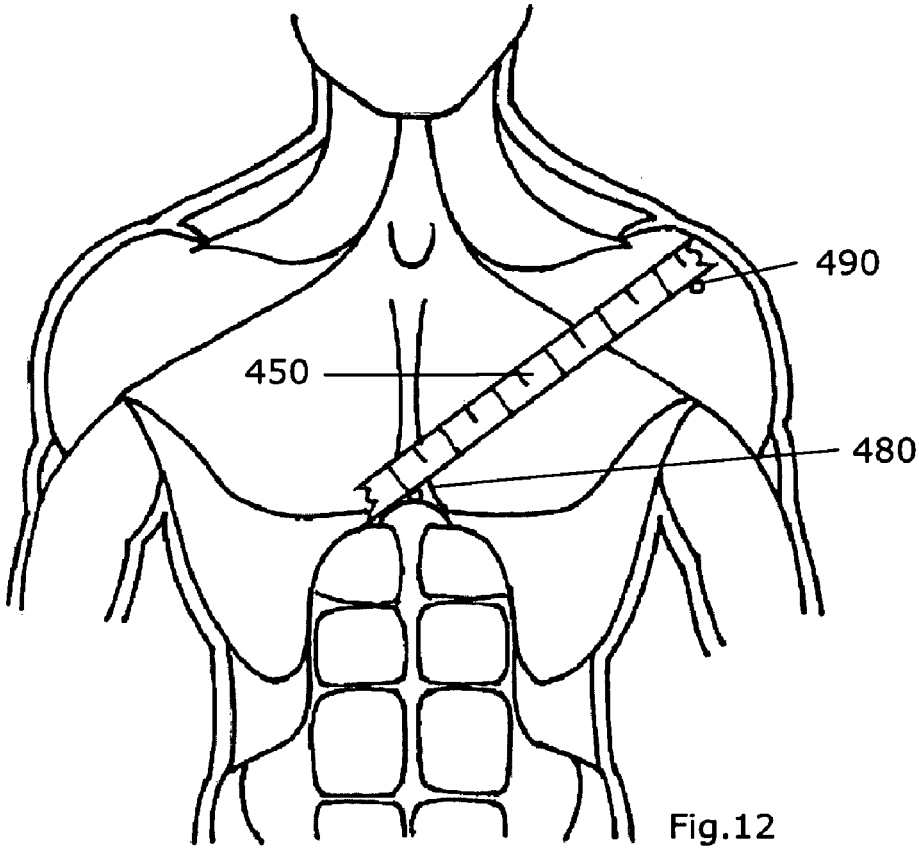
FIG. 12 is a front view of a person illustrating the "pledge" measurement.

The follow sequence illustrates a pledge measurement. Place a hand on the chest as if you were about to recite the "Pledge of Allegiance." Now, lift the ribcage upwards and notice that the distance between the fingers and the edge of the shoulder has increased. The muscle that is being lengthened, or stretched out, is the pectoris minor 210. It rests underneath the pectoris major 211 and provides the ability to hold the shoulders back. This, in turn, takes the pressure off the back muscles themselves. FIG. 12 is a front view of a person illustrating the "pledge" measurement. One end of the ruler 450 is placed at the sternum 480, and the distance to the left shoulder 490 is determined.

Shoulder to Shoulder Measurement

Figure 13:
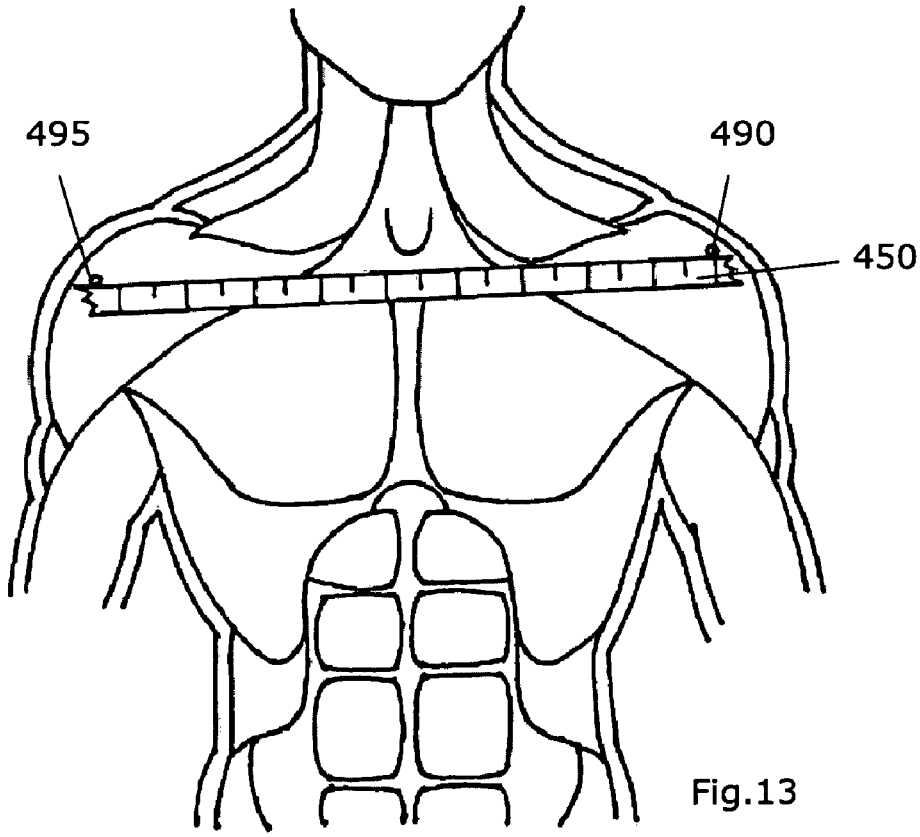
FIG. 13 is a front view of a person illustrating the "shoulder-to-shoulder" measurement.

FIG. 13 is a front view of a person illustrating a "shoulder-to-shoulder" measurement. One end of the ruler 450 is placed at the right shoulder 495, and the distance to the left shoulder 490 is determined. The shoulder-to-shoulder measurement may also be taken in the back between shoulder blades.

These measurements provide an indication of the extent that the ribcage is repositioned by rotating upwards, by lifting the ribcage upwards and towards the back. This repositioning provides a relief to the midsection of the body, and to the back. When a person slouches forward, the trapezoids and deltoids, the back muscles, stretch too far, putting undue strain on the back, and possibly resulting in back pain or discomfort.

This deliberate lifting of the ribcage may feel good, but it will provide only a momentary improvement. The ribcage will lift only as far as the stomach muscles will allow. Since the muscles attached to the ribs and the pelvic area have typically been shortened for some time, it is necessary to lengthen them in order to permit the ribcage to be sustained in a lifted position. The current invention provides a method of providing the lengthening, and measuring the results of that lengthening. As the measurements described above All those stomach muscles have to re redirected into a new and lengthened position.

In another embodiment, these measurements may be obtained indirectly such as by obtaining a digital image of the person, and using computer software to make the measurements.

It is desirable to maximize the hip to rib, pledge measurements, and shoulder to shoulder measurements. As the stretches are conducted for a few weeks, the measurements should indicate an increase in the distance between rib and hip bone, an increase in the distance between the sternum and the shoulder, and a decrease in the distance from shoulder blade to shoulder blade in the back.

These three measurements will reflect progress as the abs and pec minor are lengthened with the stretching positions. Eventually the benchmarks will increase, and the new "open" stances will be natural and comfortable as your muscles relax. Slouching will be uncomfortable and the new posture will begin to take the place of old bad habits.

It is not necessary to take these measurements with a tape measure. A piece of yarn or ribbon, cut and hung up each week will make an attractive and effective reminder of progress.

Stretch Strap

Figure 10:
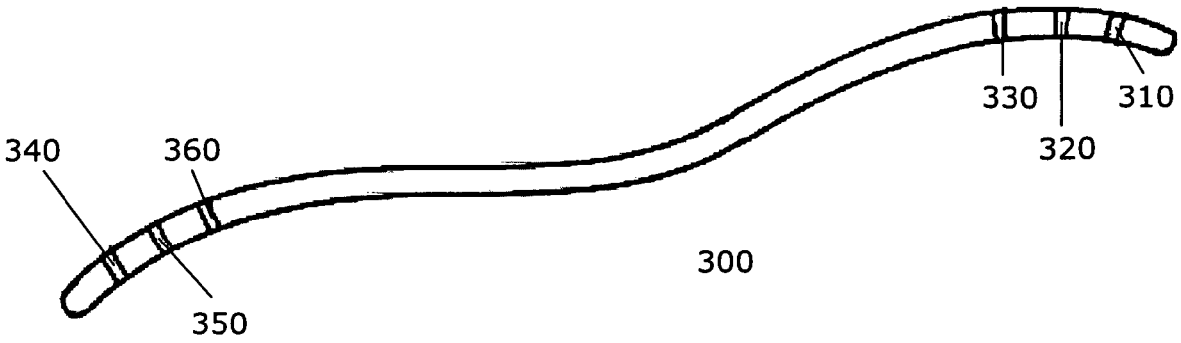
FIG. 10 is a top view of an embodiment of the stretch strap.

Although the exercises can be performed with a large towel, it is desirable to provide an elongated strap. FIG. 10 is a top view of a Balance Chord™ strap 300 which is specifically designed to facilitate the stretches. In this example, the strap is 3-4 inches wide to provide a comfortable thickness in the hands, and is 60-80 inches long in order to accommodate a large arm span. In other embodiments, other widths or lengths may be provided in order to better fit different body sizes.

The strap is preferably made of an inelastic cloth, such as denim. In one example, the strap is formed of a doubled material thickness. In other embodiments, the strap may be formed of a double material thickness, such as by bending a wider strip of material and sewing the edge.

In one example, the strap is provided with stripes 310, 320, 330, 340, 350, and 360 or other markings which assist the user in finding an appropriate position for each hand relative to the strap. In other examples, the user may try a first position, and then move one or both hands to a more desirable position.

Stretch Exercise Instructions

In this embodiment, instruction is provided on how to perform the stretches. The instruction may be in the form of a poster with illustrations or photographs of the stretch positions. The poster may further include illustrations of transition positions between one stretch to another.

In another example, the instruction is provide with a video clip which may be viewed from a computer monitor. The program may be executed or downloaded form a web site or local storage. The video clip may include desired timing of each stretch and may include an audio portion such as directing the participant on desired breathing patterns during the stretches.

In another example, a video clip may be provided through a television such as by tape, DVD, or live transmission.

The poster or video instructions may further include illustrations or direction on how to take the measurements.

Log Book

In this embodiment, a log book is provided to permit the participant to easily record the day and time of each stretch sequence. The log book may suggest and accommodate periodic measurements such as the rib-to-hip, pledge, and shoulder-to-shoulder measurements. In this manner, a participant can be encouraged by improvement in the measurements and can be encouraged to regularly perform the stretches.

What is claimed is:

1. A method of improving the posture of a human by lengthening the muscles of the torso, the human having a head, left arm, left hand, right arm, right hand, and rib area, the method consisting essentially of performing a series of static stretching protocols in a 3 to 5 minute session by performing a left Archer stretch protocol comprising grasping a strap with the right hand and the left hand, positioning the strap behind the head, inhaling a breath, extending the left arm, bending the right arm, such that the upper portion of the right arm contacts the rib area, and applying tension to the strap while exhaling slowly;

performing a right Archer stretch protocol comprising grasping the strap with the right hand and the left hand, positioning the strap behind the head, inhaling a breath, extending the right arm, bending the left arm, such that the upper portion of the left arm contacts the rib area, and applying tension to the strap while exhaling slowly;

performing a left Liberty stretch protocol comprising grasping the strap with the right hand and the left hand, positioning the strap behind the head, inhaling a breath, extending the left arm above the head with the left elbow bent, extending the right arm at a downward angle, such that the right arm and the left elbow lie approximately along the same line, and applying tension to the strap while exhaling slowly;

performing a right Liberty stretch protocol comprising grasping the strap with the right hand and the left hand, positioning the strap behind the head, inhaling a breath, extending the right arm above the head with the right elbow bent, extending the left arm at a downward angle, such that the left arm and the right elbow lie approximately along the same line, and applying tension to the strap while exhaling slowly;

performing a Victory stretch protocol comprising grasping the strap with the right hand and the left hand, positioning the strap behind the head, inhaling a breath, extending the left arm at an upward angle above the head, extending the right arm at an upward angle above the head, and applying tension to the strap while exhaling slowly; and performing a Balance stretch protocol comprising grasping the strap with the right hand and the left hand, positioning the strap behind the waist, bending the left arm, such that the upper portion of the left arm contacts the rib area, bending the right arm, such that the upper portion of the right arm contacts the rib area, inhaling a breath, extending the left hand approximately horizontally from the left elbow, extending the right hand approximately horizontally from the right elbow, and applying tension to the strap while exhaling slowly.

2. The method of claim 1 wherein the stretch protocols are performed with a non-elastic strap.

3. The method of claim 1 wherein the stretch protocols are performed with instruction.

4. The method of claim 3 wherein the instruction is provided through a television monitor.

5. The method of claim 3 wherein the instruction is provided through a computer monitor.

6. The method of claim 3 wherein the instruction is provided with an instructor.

7. The method of claim 3 wherein the instruction is provided with a poster, such that the poster illustrates the position of each stretch protocol.

8. The method of claim 1 further comprising periodically taking a measurement of posture improvement, the measurement selected from the group consisting of a hip to rib measurement, a sternum to shoulder measurement, and a shoulder to shoulder measurement.

9. The method of claim 8 wherein the periodic measurements are recorded.

* * * * *